US008141419B2

(12) United States Patent
Tchakarov et al.

(10) Patent No.: US 8,141,419 B2
(45) Date of Patent: Mar. 27, 2012

(54) IN-SITU FORMATION STRENGTH TESTING

(75) Inventors: Borislav J. Tchakarov, Humble, TX (US); Mohammed Azeemuddin, Sugar Land, TX (US); See H. Ong, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 652 days.

(21) Appl. No.: 12/323,128

(22) Filed: Nov. 25, 2008

(65) Prior Publication Data

US 2009/0133486 A1 May 28, 2009

Related U.S. Application Data

(60) Provisional application No. 60/990,516, filed on Nov. 27, 2007.

(51) Int. Cl.
*E21B 49/02* (2006.01)
*G01N 33/24* (2006.01)

(52) U.S. Cl. ..... 73/152.59; 73/784

(58) Field of Classification Search ..... 73/152.59, 73/784

See application file for complete search history.

(56) References Cited

U.S. PATENT DOCUMENTS 2,281,960 A * 5/1942 Vacquier ..... 73/152.16
2,927,459 A * 3/1960 Farrington ..... 73/152.59
3,446,062 A * 5/1969 Goodman et al. ..... 73/84
3,562,916 A * 2/1971 Duckworth ..... 33/788
3,572,114 A * 3/1971 Ruppeneit et al. ..... 73/152.59
3,785,200 A * 1/1974 Handy ..... 73/152.59
3,872,717 A * 3/1975 Fox ..... 73/84
3,961,524 A * 6/1976 de la Cruz ..... 73/783
3,992,928 A 11/1976 Thoms ..... 73/88
4,075,885 A * 2/1978 Handy et al. ..... 73/784
4,149,409 A * 4/1979 Serata ..... 73/152.03
4,461,171 A 7/1984 de la Cruz
4,510,799 A 4/1985 Overmier ..... 73/151
4,537,063 A 8/1985 Barnaby ..... 73/38
4,539,851 A * 9/1985 Lutenegger ..... 73/845
4,692,707 A 9/1987 Locke et al. ..... 324/374
4,773,259 A * 9/1988 Handy ..... 73/84
4,899,320 A * 2/1990 Hearn et al. ..... 367/35
5,042,595 A * 8/1991 Ladanyi ..... 175/50
5,165,274 A 11/1992 Thiercelin
5,323,648 A * 6/1994 Peltier et al. ..... 73/152.17
5,487,433 A 1/1996 MacKay et al. ..... 175/78
5,517,854 A * 5/1996 Plumb et al. ..... 73/152.59
5,576,485 A * 11/1996 Serata ..... 73/152.17
6,164,126 A 12/2000 Ciglenec et al. ..... 73/152.01

(Continued)

OTHER PUBLICATIONS

International Search Report and Written Opinion, dated Jun. 11, 2009, 8 pages.

(Continued)

*Primary Examiner* — John Fitzgerald
(74) *Attorney, Agent, or Firm* — Shawn Hunter

(57) ABSTRACT

Estimating formation properties includes a member coupled to a carrier, the member having a distal end that engages a borehole wall location, the distal end having a curved surface having a radius of curvature in at least one dimension about equal to or greater than a borehole radius. A drive device extends the first extendable member with a force sufficient to determine formation strength, and at least one measurement device providing an output signal indicative of the formation property. Articulating couplings may be used to change an angle of extension of the extendable member.

15 Claims, 7 Drawing Sheets

U.S. PATENT DOCUMENTS

| | | | | |
|---|---|---|---|---|
| 6,234,257 | B1 | 5/2001 | Ciglenec et al. | |
| 6,581,455 | B1 | 6/2003 | Berger et al. | 73/152.55 |
| 7,152,466 | B2 | 12/2006 | Ramakrishnan et al. | 73/152.51 |
| 7,921,730 | B2 * | 4/2011 | Tan | 73/784 |
| 2004/0237640 | A1 * | 12/2004 | Meister et al. | 73/152.48 |
| 2005/0194134 | A1 | 9/2005 | McGregor et al. | 166/264 |
| 2006/0000603 | A1 | 1/2006 | Zazovsky et al. | 166/244.1 |
| 2007/0137894 | A1 | 6/2007 | Fujisawa et al. | 175/20 |
| 2009/0164128 | A1 | 6/2009 | Tchakarov et al. | 702/11 |
| 2010/0051347 | A1 | 3/2010 | Tchakarov et al. | 175/50 |

OTHER PUBLICATIONS

International Search Report dated Feb. 4, 2009.

* cited by examiner

IN-SITU FORMATION STRENGTH TESTING

CROSS-REFERENCE TO RELATED APPLICATIONS

The present application is a non-provisional application of U.S. provisional application 60/990,516 filed on Nov. 27, 2007, the entire specification being hereby incorporated herein by reference.

BACKGROUND

1. Technical Field

The present disclosure generally relates to well bore tools and in particular to methods and apparatus for estimating in-situ formation properties downhole.

2. Background Information

Oil and gas wells have been drilled at depths ranging from a few thousand feet to as deep as five miles. A large portion of the current drilling activity involves directional drilling that includes drilling boreholes deviated from vertical by a few degrees to horizontal boreholes, to increase the hydrocarbon production from earth formations.

Information about the subterranean formations traversed by the borehole may be obtained by any number of techniques. Techniques used to obtain formation information include obtaining one or more core samples of the subterranean formations and obtaining fluid samples produced from the subterranean formations these samplings are collectively referred to herein as formation sampling. Core samples are often retrieved from the borehole and tested in a rig-site or remote laboratory to determine properties of the core sample, which properties are used to estimate formation properties. Modern fluid sampling includes various downhole tests and sometimes fluid samples are retrieved for surface laboratory testing.

Laboratory tests suffer in that in-situ conditions must be recreated using laboratory test fixtures in order to obtain meaningful test results. These recreated conditions may not accurately reflect actual in-situ conditions and the core and fluid samples may have undergone irreversible changes in transit from the downhole location to the surface laboratory. Furthermore, downhole fluid tests do not provide information relating to formation direction and other rock properties.

SUMMARY

The following presents a general summary of several aspects of the disclosure in order to provide a basic understanding of at least some aspects of the disclosure. This summary is not an extensive overview of the disclosure. It is not intended to identify key or critical elements of the disclosure or to delineate the scope of the claims. The following summary merely presents some concepts of the disclosure in a general form as a prelude to the more detailed description that follows.

Disclosed is an apparatus for estimating one or more formation properties. The apparatus includes a carrier conveyable in a well borehole to a formation. A member having a distal end that engages a borehole wall is carried by the carrier, and the distal end has a surface with a radius of curvature in at least one dimension about equal to or greater than a radius of the well borehole. A drive device engages the member with a force sufficient to determine formation strength.

In one aspect of the disclosure, an apparatus for estimating a formation property includes a carrier that is conveyable in a well borehole to a formation. An extendable member applies force to a borehole wall in a first direction, the extendable member having a selective angle of extension with respect to a carrier longitudinal axis. At least one measurement device provides an output signal indicative of the angle of extension of the extendable member, the angle of extension being used in part for estimating the formation property.

An exemplary method for estimating a formation property includes applying force to a borehole wall portion in a first direction using an extendable member having an selective angle of extension with respect to a carrier longitudinal axis. The exemplary method may further include using a value representative of the angle of extension in part to estimate the one or more formation properties.

Another aspect of the disclosed method for estimating a formation property includes applying force to a borehole wall portion using a first member having a distal end that engages a borehole wall, the distal end having a surface with a radius of curvature in at least one dimension about equal to or greater than a radius of the well borehole. Force may be applied to a borehole wall portion using a second extendable member having a distal end having a surface smaller than the surface of the first extendable member and in-situ parameters are measured while force is being applied to the formation by the first extendable member and by the second extendable member. The formation property may be estimated at least in part using the measured in-situ parameters.

BRIEF DESCRIPTION OF THE DRAWINGS

For a detailed understanding of the present disclosure, reference should be made to the following detailed description of the several non-limiting embodiments, taken in conjunction with the accompanying drawings, in which like elements have been given like numerals and wherein.

DESCRIPTION OF EXEMPLARY EMBODIMENTS

Formation properties include several components that may be measured in-situ or estimated using in-situ measurements provided by the formation strength test tool of the present disclosure. The several components of formation properties include stress, Young's modulus, Poisson's Ratio and formation unconfined compressive strength. A short discussion of these formation properties follows.

Stress on a given sample is defined as the force acting on a surface of unit area. It is the force divided by the area as the area approaches zero. Stress has the units of force divided by area, such as pounds per square inch, or psi, kilo Pascals (kilo Newtons per square meter), kPa, MPa, etc. A given amount of force acting on a smaller area results in a higher stress, and vice versa.

The Young's modulus of a rock sample is the stiffness of the formation, defined as the amount of axial load (or stress) sufficient to make the rock sample undergo a unit amount of deformation (or strain) in the direction of load application, when deformed within its elastic limit. The higher the Young's modulus, the harder it is to deform it. It is an elastic property of the material and is usually denoted by the English alphabet E having units the same as that of stress.

The Poisson's ratio of an elastic material is also its material property that describes the amount of radial expansion when subject to an axial compressive stress (or deformation measured in a direction perpendicular to the direction of loading). Poisson's ratio is the ratio of the elastic material radial deformation (strain) to its axial deformation (strain), when deformed within its elastic limit. Rocks usually have a Poisson's ratio ranging from 0.1 to 0.4. The maximum value of Poisson's ratio is 0.5 corresponding to an incompressible material (such as water). It is denoted by the Greek letter ν (nu). Since it is a ratio, it is unitless.

A material's Unconfined Compressive Strength (UCS) is its maximum compressive stress the material withstands before undergoing failure. It is usually determined in the laboratory on cylindrical cores that are subjected to axial compressive stress under unconfined conditions (no lateral support or confining pressure being applied on the sides). UCS has the same units as that of stress (force per unit area: psi, MPa, etc.).

In-situ stresses are the stresses that exist within the surface of the earth. There are three principal (major) stresses acting on any element within the surface of the earth. The three stresses are mutually perpendicular to one another and include the vertical (overburden) stress resulting from the weight of the overlying sediments ($\sigma_v$), the minimum horizontal stress ($\sigma_{Hmin}$) resulting from Poisson's effect, and maximum horizontal stress ($\sigma_{Hmax}$) resulting from Poisson's and tectonic/thermal effects.

Figure 1:
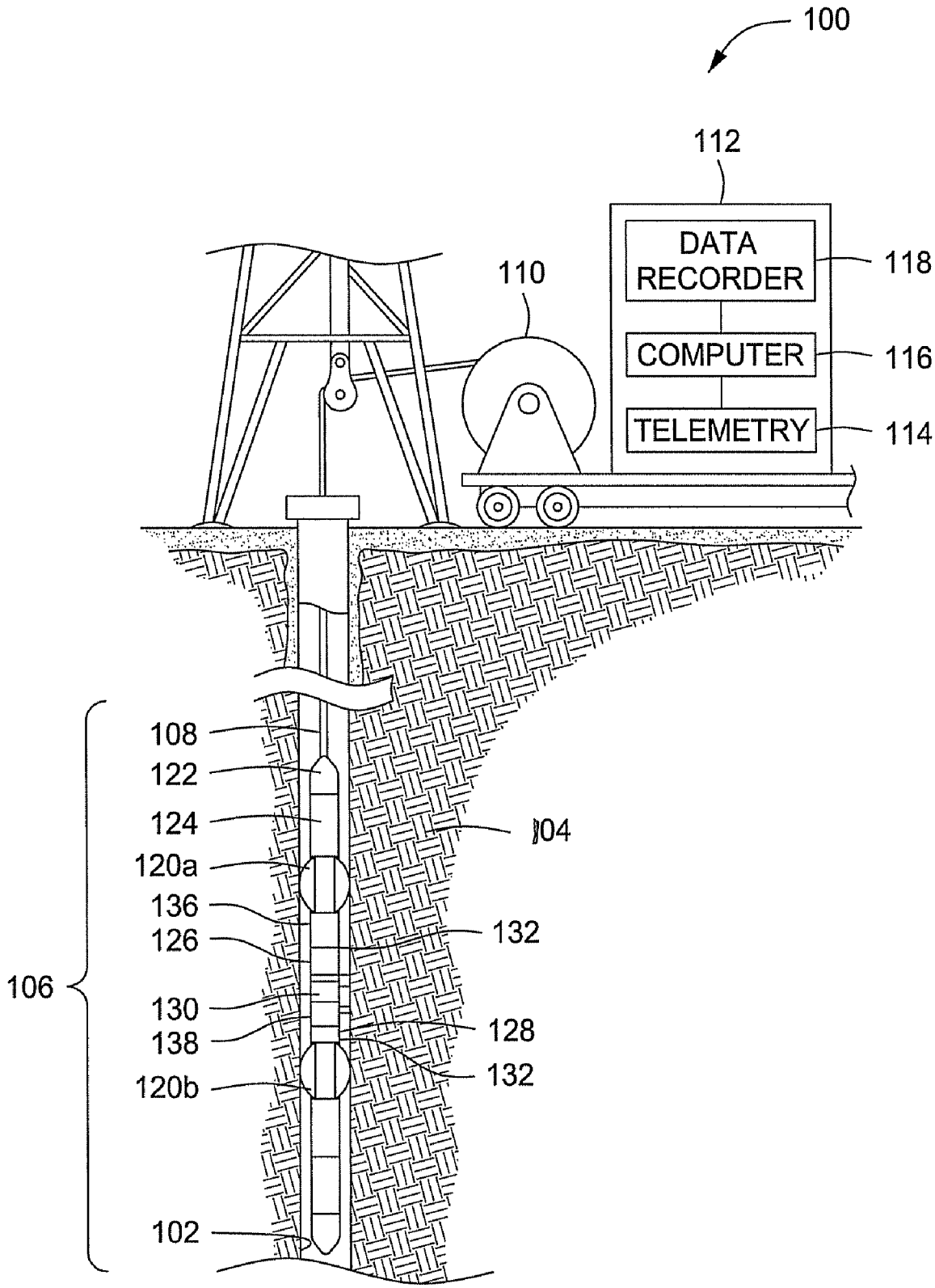
FIG. 1 illustrates a non-limiting example of a wireline logging apparatus according to several embodiments of the disclosure.

FIG. 1 is an elevation view of a non-limiting well logging apparatus 100 according to several embodiments of the disclosure. The well logging apparatus 100 is shown disposed in a well borehole 102 penetrating earth formations 104 for making measurements of properties of the earth formations 104. The borehole 102 is typically filled with a fluid having a density sufficient to prevent formation fluid influx.

A string of logging tools, or simply, tool string 106 is shown lowered into the well borehole 102 by an armored electrical cable 108. The cable 108 can be spooled and unspooled from a winch or drum 110. The tool string 106 may be configured to convey information to surface equipment 112 by an electrical conductor and/or an optical fiber (not shown) forming part of the cable 108. The surface equipment 112 can include one part of a telemetry system 114 for communicating control signals and data to the tool string 106 and may further include a computer 116. The computer can also include a data recorder 118 for recording measurements made by tool string sensors and transmitted to the surface equipment 112.

The exemplary tool string 106 may be centered within the well borehole 102 by a top centralizer 120*a* and a bottom centralizer 120*b* attached to the tool string 106 at axially spaced apart locations. The centralizers 120*a*, 120*b* can be of types known in the art such as bowsprings or inflatable packers. In other non-limiting examples, the tool string 106 may be forced to a side of the borehole 102 using one or more extendable members.

The tool string 106 of FIG. 1 illustrates a non-limiting example of an in-situ formation strength test tool, along with several examples of supporting functions that may be included on the tool string 106. The tool string 106 in this example is a carrier for conveying several sections of the tool string 106 into the well borehole 102. The tool string 106 includes an electrical power section 122 and an electronics section 124 is coupled to the electrical power section 122. A mechanical power section 126 is disposed on the tool string 106 and is coupled in this example to the electronics section 124. A mandrel section 128 is shown disposed on the tool string 106 below the mechanical power section 126 and the mandrel section 128 includes a formation strength test device 130.

The electrical power section 122 receives or generates, depending on the particular tool configuration, electrical power for the tool string 106. In the case of a wireline configuration as shown in this example, the electrical power section 122 may include a power swivel that is connected to the wireline power cable 108. In the case of a while-drilling tool, the electrical power section 122 may include a power generating device such as a mud turbine generator, a battery module or other suitable downhole electrical power generating device. In some examples wireline tools may include power generating devices and while-drilling tools may utilize wired pipes for receiving electrical power and communication from the surface. The electrical power section 122 may be electrically coupled to any number of downhole tools and to any of the components in the tool string 106 requiring electrical power. The electrical power section 122 in the example shown provides electrical power to the electronics section 124.

Figure 2:
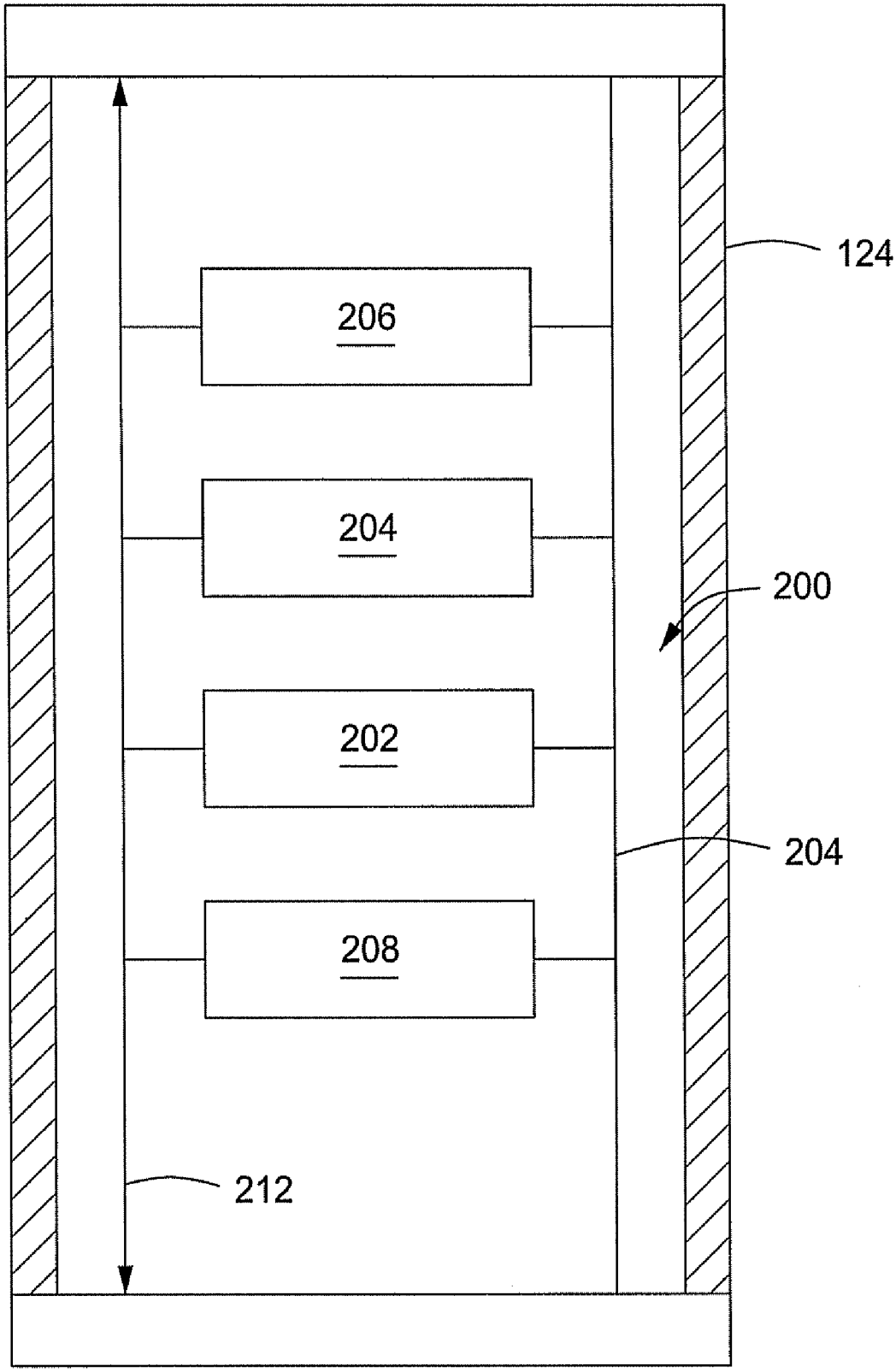
FIG. 2 is a non-limiting example of a downhole electronics section that may be used with the logging apparatus of FIG. 1.

With reference to FIGS. 1 and 2, the electronics section 124 may include any number of electrical components for facilitating downhole tests, information processing and/or storage. In some non-limiting examples, the electronics section 124 includes a processing system 200 that includes at least one information processor 202. The processing system 200 may be any suitable processor-based control system suitable for downhole applications and may utilize several processors depending on how many other processor-based applications are to be included in the tool string 106. Some electronic components may include added cooling, radiation hardening, vibration and impact protection, potting and other packaging details that do not require in-depth discussion here. Processor manufacturers that produce processors 202 suitable for downhole applications include Intel, Motorola, AMD, Toshiba and others.

In wireline applications, the electronics section 124 may be limited to transmitter and receiver circuits to convey information to a surface controller and to receive information from the surface controller via a wireline communication cable. In the example shown, the processor system 200 further includes a memory unit 204 for storing programs and information processed using the processor 202. Transmitter and receiver circuits 206 are included for transmitting and receiving information to and from the tool string 106. Signal conditioning circuits 208 and any other electrical component suitable for the tool string 106 may be housed within the electronics section 124. A power bus 210 may be used to communicate electrical power from the electrical power section 122 to the several components and circuits housed within the electronics section 124. A data bus 212 may be used to communicate information between the mandrel section 128 and the processing system 200 and between the processing 200 and the surface computer 116 and recorder 118. The electrical power section 122 and electronics section 124 may be used to provide power and control information to the mechanical power section 126 where the mechanical power section 126 includes electro-mechanical devices.

In the non-limiting example of FIG. 1, the mechanical power section 126 may be configured to include any number of power generating devices 136 to provide mechanical power to the formation strength test device 130. The power generating device or devices 136 may include one or more of a hydraulic unit, a mechanical power unit, an electro-mechanical power unit or any other unit suitable for generating mechanical power for the mandrel section 128 and other not-shown devices requiring mechanical power.

In several non-limiting examples, the mandrel section 128 may utilize mechanical power from the mechanical power section 126 and may also receive electrical power from the electrical power section 126. Control of the mandrel section 128 and of devices on the mandrel section 128 may be provided by the electronics section 124 or by a controller disposed on the mandrel section 128. In some embodiments, the power and control may be used for orienting the mandrel section 128 within the well borehole. The mandrel section 128 can be configured as a rotating sub that rotates about and with respect to the longitudinal axis of the tool string 106. Bearing couplings 132 and drive mechanism 134 may be used to rotate the mandrel section 128. In other examples, the mandrel section 128 may be oriented by rotating the tool string 106 and mandrel section 128 together. The electrical power from the electrical power section 122, control electronics in the electronics section 124, and mechanical power from the mechanical power section 126 may be in communication with the mandrel section 128 to power and control the formation strength test device 130.

Figure 3:
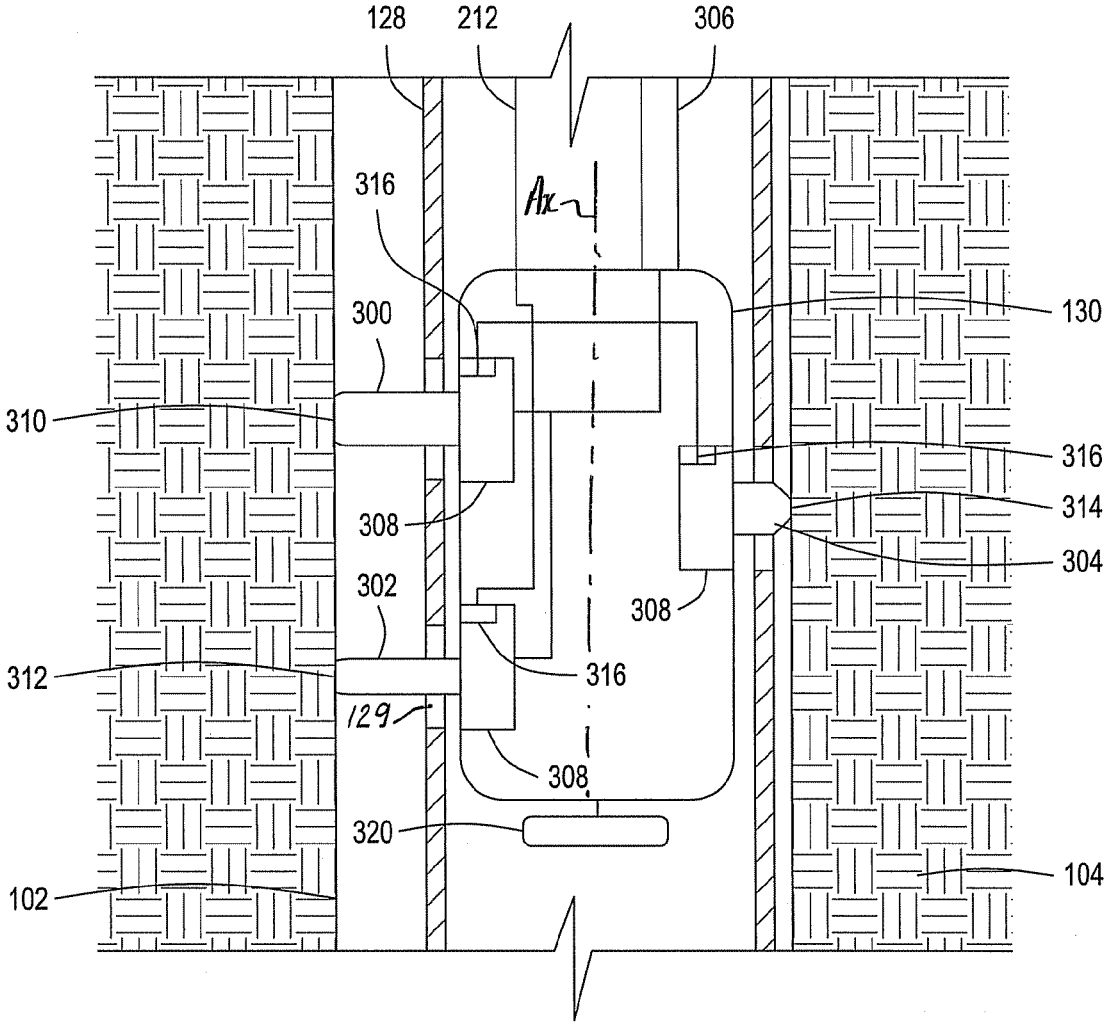
FIG. 3 is an elevation cross section of an exemplary mandrel section that includes an exemplary formation strength test device according to the disclosure.

Referring now to FIGS. 1 and 3, the formation strength test device 130 of the present disclosure may include one or more extendable pistons 300, 302, 304 that receive mechanical power from the mechanical power section 126 via a power transfer medium 306 coupled to the power generating device 136. The power transfer medium 306 may be selected according to the particular power generating devices 136 used. For example, the power transfer medium 306 may be a hydraulic fluid conduit where the power generating device 136 includes a hydraulic pump, the power transfer medium may be an electrical conductor where the power generating device 136 includes an electrical power generator, and the power transfer medium 306 may be a drive shaft or gearbox where the power generating device 136 includes a mechanical power output for extending the pistons 300, 302, 304. Each of the extendable pistons 300, 302, 304 may have a corresponding housing 308 that includes hydraulic, or mechanical assemblies used to extend the respective piston 300, 302, 304. The one or more extendable pistons 300 may be extended from within the mandrel section 128 through a passage 129 in the mandrel section 128 to engage the borehole wall with sufficient force to measure a formation property. In several examples the force may be selected to deform or fracture the formation, the deformation or fracture may occur at or adjacent the piston-formation interface.

Each of the pistons in the example shown includes a wall-engaging end 310, 312, 314. As discussed in more detail below, each end 310, 312, 314 may have a unique profile and also may have a unique contact. The exemplary formation strength test device 130 includes one piston 300 having a wall-engaging end 310. The wall engaging end 310 may be profiled to have a radius of curvature about equal to the borehole radius. A second of the extendable pistons 302 includes a wall-engaging end 312 with a surface area that is smaller than the end 310 of the first piston 300. The third of the extendable pistons 304 includes a wall-engaging end 314 with a surface area that is smaller than either of the first and second pistons.

The surface area for each end 310, 312, 314 may be defined as the contact area between each end 310, 312, 314, and the formation wall. Examples of contact area include a designed contact area, actual contact area, and effective contact area. The end 314 of the third piston 304 may include a pointed or chisel-shaped end to increase the force per unit area. Information relating to the speed of extension, force applied by the respective piston, distance of piston travel and the like may be monitored by suitable sensors 316 associated with the respective piston. Information measured by the sensors 316 may be transmitted to the electronics section 124 via the data bus 212 for processing. Alternative embodiments exist wherein any end 310, 312, 314 may be the uppermost end, optionally all ends 310, 312, 314 may be at substantially the same location along the device's 130 axis Ax. Yet further optionally, each end 310, 312, 314 may extend from any angle about the device's 130 circumference.

The several wall-engaging ends 310, 312, 314 described above may be constructed using any of several surface topologies without departing from the scope of the disclosure. FIGS. 4A through 4D illustrate several non-limiting examples of wall-engaging end shapes that may be included with a distributed force piston such as the first piston 300 and second piston 302. FIGS. 5A through 5G illustrate several non-limiting examples of wall-engaging end shapes that may be included with a concentrated force piston such as the third piston 306.

Figure 4A:
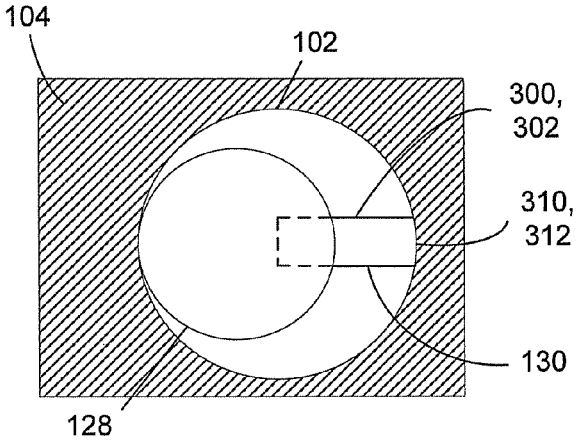
FIGS. 4A through 4D illustrate examples of surface topology that may be used with a distributed force piston according to the disclosure.

FIG. 4A schematically illustrates a non-limiting example of a formation strength test device 130 disposed on a tool mandrel 128 within a well borehole 102 and in contact with a borehole wall portion against a subterranean formation 104. As described above, the formation strength test device 130 may include several extendable pistons. In this example, the piston 300, 302 may be either of the larger two pistons described above and shown in FIG. 3. The piston 300, 302 here is shown extended with a piston wall-engaging end portion 310, 312 in contact with the borehole wall on one side and with the mandrel 128 being forced against an opposite side of the borehole.

Figure 4B:
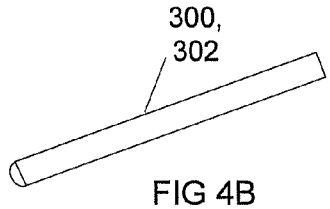
Figure 4C:
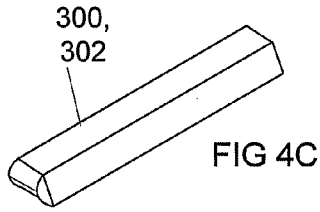
Figure 4D:
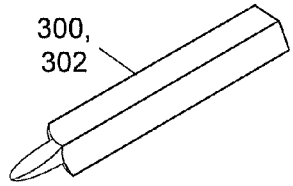

The piston end portion 310, 312 has a surface shaped such that force applied to the piston in the form of hydraulic, mechanical or electromechanical linear force is distributed on the borehole wall by a contact surface at the piston end portion that may be selected based at least in part on the size of the borehole. The particular shape may be any number of shapes that distribute the applied force over a borehole wall area. FIGS. 4B through 4D illustrate a few exemplary shapes that may be used as the contact surface of the extendable piston 300, 302. FIG. 4B shows a piston having a substantially dome-shaped end portion. In one example of a dome-shaped end portion, the end portion and borehole may have substantially similar curvatures.

FIG. 4C shows a piston with a generally rectangular cross section with a curved end portion. Optionally, the curved end portion and borehole radius of curvature are substantially similar. The length of the cylinder may be any useful length that allows for adequate force distribution to avoid point loading on the borehole wall. Although not essential, the length of the cylinder may be about equal to or greater than the surface radius of curvature.

In another optional embodiment illustrated in FIG. 4D, a piston includes an end portion, wherein cross sections taken parallel and perpendicular to the piston axis are both substantially elliptical. In this example, the contact surface has a major radius of curvature about equal to the borehole radius and a minor radius of curvature that is less than the major radius of curvature but large enough to avoid ridge loading on the borehole wall. The second, or medium-sized, piston 302 may be shaped substantially similar to the larger piston 300 but with a different contact surface area. Embodiments exist where the second piston 302 surface area ranges from about 50% to about 90% the larger piston 300 area.

Figure 5A:
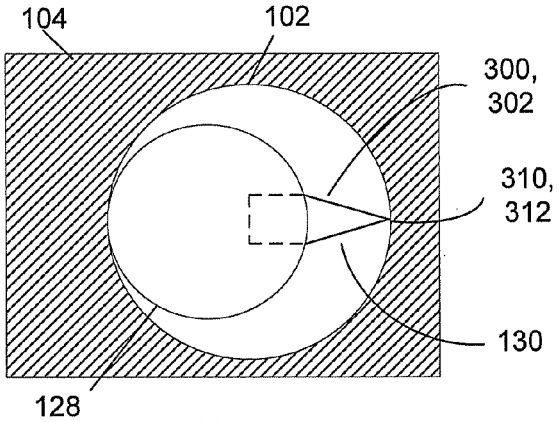
FIGS. 5A through 5G illustrate examples of surface topology that may be used with a concentrated force piston according to the disclosure.

FIG. 5A illustrates a non-limiting example of a formation strength test device 130 disposed on a tool mandrel 128 within a well borehole 102 and in contact with a borehole 102 wall portion against a subterranean formation 104. As described above and shown in FIGS. 1-3, the formation strength test device 130 may include an extendable piston 304 that concentrates applied force to the borehole 102 wall. In this example, the mandrel 128 is shown against one side of the borehole 102 with the piston 304 contacting the borehole 102 wall closest the mandrel 128. The piston 304 includes a piston end portion 314 in contact with the borehole 102 wall where the mandrel 128 is forced against the borehole 102 side. The piston end portion 314 has a surface shaped such that force applied to the piston in the form of hydraulic, mechanical or electromechanical linear force, transfers to the borehole 102 wall along a contact surface at the piston end portion 314. The particular shape may be any number of shapes. In the example of a concentrated force test, point and ridge loading are acceptable.

Figure 5B:
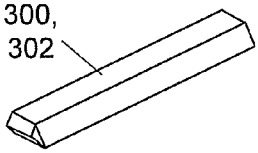
Figure 5C:
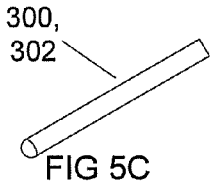
Figure 5D:
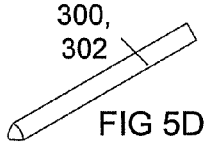
Figure 5E:
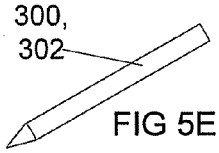
Figure 5F:
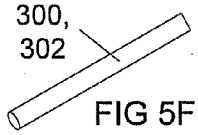
Figure 5G:
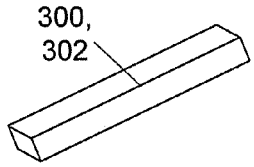

FIGS. 5B through 5G illustrate a few exemplary shapes that may be used as the contact surface of the extendable piston 304 shown in FIG. 5A. FIG. 5B shows a piston end portion having a chisel-shaped surface. FIG. 5C illustrates an end portion having a dome-shaped surface. FIG. 5D shows a frustum-shaped end and FIG. 5E shows a cone-shaped piston end portion. Since the concentrated force piston allows for small contact area, flat surfaces may be used. For example, FIG. 5F illustrates a flat-end cylindrical shape and FIG. 5G shown a flat-ended polygonal shape for the end portion. The wall-engaging end of any of the several pistons thus described may provide additional useful information where the piston can be articulated in several degrees of freedom.

Figure 6:
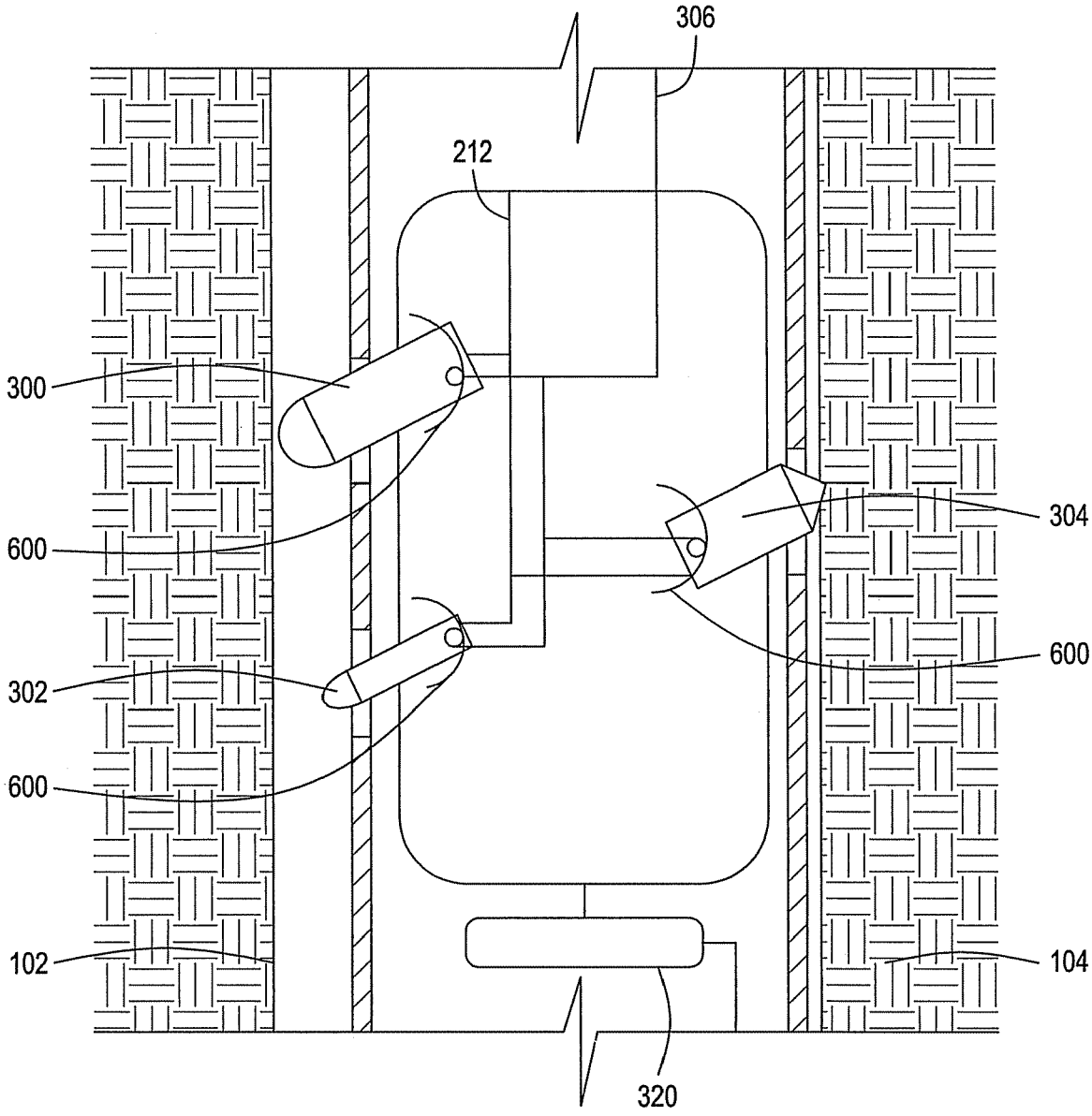
FIG. 6 is an exemplary formation strength test tool having articulated piston couplings.

The formation strength test device 130 described above and shown in the several exemplary views may include one or more articulated piston assemblies to move the respective pistons 300, 302, 304 in several angular directions with respect to the mandrel 128 longitudinal axis. Referring to FIG. 6, the mandrel 128 may include one or more extendable pistons 300, 302, 304 substantially as described above and shown in FIG. 3. Each piston 300, 302, 304 may be movably coupled to the mandrel 128 in a moveable relationship using a coupling 600 that allows articulated movement with at least one degree of freedom to engage the formation 104 at a desired angle of engagement. Thus formation 104 measurements can be made while orienting the pistons 300, 302, 304 at any angle with respect to the borehole 102 wall, and the pistons 300, 302, 304 can be at the same or different angles. Moreover, each piston 300, 302, 304 can be deployed more than once for obtaining formation 102 measurements, where each deployment angle can vary. Thus deployment angle dependent formation 104 property information can also be obtained using the device described herein. This information may be used in estimating directional properties of the formation 104 at the formation-borehole interface.

The angle of extension can be determined in part by the tool 130 angular position with respect to vertical and/or the borehole 102. In several examples, tool 130 angle and borehole 102 angle may be substantially the same, and in other examples the tool 130 may be angularly displaced within the borehole 102. In each case the tool 102 angle may be determined using magnetometers, accelerometers and/or other suitable sensors 320 to determine the tool 130 orientation and angle in real time. The angle of extension can also be determined in part by a formation 104 boundary angle with respect to vertical and/or the borehole 102 or by a combination of the tool 130 angle and the formation 104 boundary angle. The formation boundary angle can be estimated from preexisting seismic information or by formation pressure tests designed to determine in real time the upper and lower formation boundaries at the borehole-formation intersection. An advantage of angling the pistons 300, 302, 304 to obtain formation properties is that three dimensional formation property measurements are obtainable. The angled pistons 300, 302, 304 coupled with the rotating mandrel 128 provides further sampling advantages, such as more precise three dimensional formation property estimates.

The coupling 600 may be, for example, a ball-joint coupling, a pivot pin coupling, a rail coupling, a rack and pinion coupling or the like. Each coupling may be controllably manipulated using commands generated from the surface by an operator or by the surface computer 116. In other embodiments couplings may be controllably manipulated using commands generated by the downhole processing system 200 of FIG. 2. Shown schematically in FIG. 6 are rack and pinion type couplings 600 with the pinion being rotatable by a suitable drive device that receives control signals via the power medium 306 described above and shown in FIG. 3. Likewise, the commanding information may be received at each coupling via the data bus 212 where the couplings are suited for receiving control signals. One example of such data bus control may include couplings having individual electrical stepper motors (not shown) with on-board controllers. A position command may be sent to each motor independently such that the associated stepper motor may position the angle of the respective piston 300, 302, 304 as desired. Individual positioning may alternatively be accomplished using individual hydraulic pumps and reservoirs or by using controllable valves to position each piston 300, 302, 304 as desired. Whether the particular piston 300, 302, 304 is configured for articulated angular motion or for unarticulated linear movement, the force applied to the formation 104 location engaged by the piston 300, 302, 304 and the piston wall-engaging surface characteristics may be known and/or measured. Some formation 104 parameters may be estimated from the applied force useful for indicating formation 104 strength and/or other formation properties as discussed above.

Figure 7:
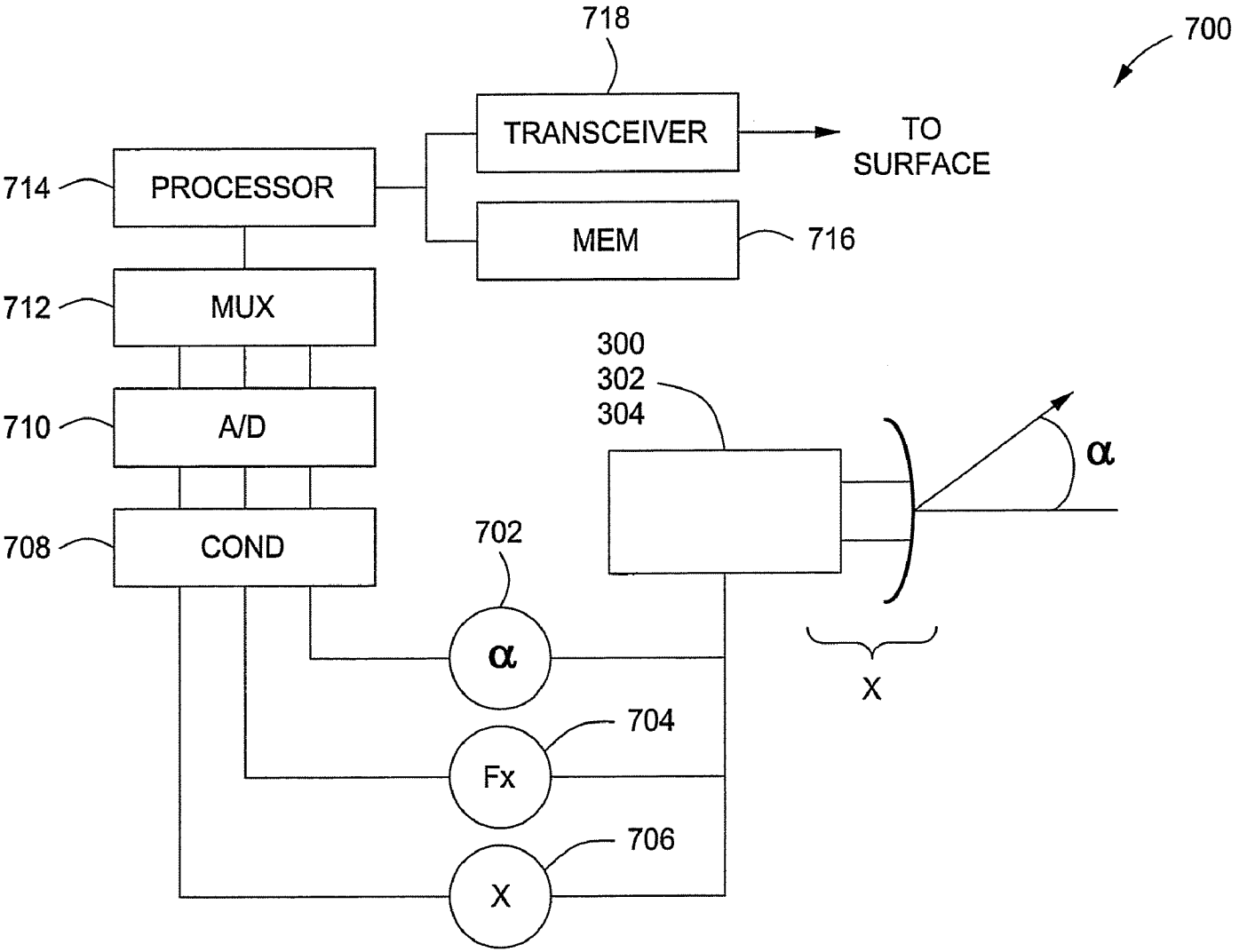
FIG. 7 schematically represents measurement and control circuits that may be used according to several embodiments of the disclosure.

FIG. 7 is a schematic illustration of a measurement and control circuit 700 that may be used according to the present disclosure. The measurement and control circuit 700 includes one or more position sensors 702, force sensors 704 and displacement sensors 706 to measure parameters such as angle $\alpha$, force F and extension X for each of the extendable pistons 300, 302, 304. The sensors 702, 704, 706 may be coupled to transmit sensor output signals to respective signal conditioning circuits 708 for filtering the signals as needed. The signal conditioning circuits may be coupled to transmit conditioned signals to an analog-to-digital converter (ADC) circuit 710 where any of the sensors does not provide a digital output signal. ADC circuit 710 output signals may be fed into a multiplexer circuit 712 or into a multi-channel input of a processor 714. The processor 714 may then feed processed signals to a memory 716 and/or to a transceiver circuit 718. The processor 714 may be located on the tool string 106 as noted above or may be a surface processor such as the processor 116 described above and shown in FIG. 1.

When using a downhole processor, commands may be received via the transceiver circuit 718. Downhole command and control of the tool string 106 and of the pistons 300, 302, 304 may be accomplished using programmed instructions stored in the memory 716 or other computer-readable media that are then accessed by the processor 714 and used to conduct the several methods and downhole operations disclosed herein. The information obtained from the sensors may be processed down-hole using the electronics section 124 with the processed information being stored downhole in the memory 716 for later retrieval. In other embodiments, the processed information may be transmitted to the surface in real time in whole or in part using the transceiver 718.

Referring now to the several exemplary views of FIGS. 1-7 and the description of the several non-limiting examples above, operation of a logging tool for estimating formation strength using in-situ measurements may now be explained. A tool such as a wireline tool as described above may be conveyed into a well borehole 102 to a subterranean formation of interest 104. Properties of the formation of interest 104 may be estimated using in-situ measurements and one or more extendable pistons 300, 302, 304 that are extended from the tool to engage the formation at one or more borehole wall locations. Formation directional properties are rarely directly perpendicular or parallel to a borehole axis. Quite often, the direction of stratification with respect to the borehole is unknown to the well site operator and geologists. Thus, several embodiments disclosed provide multi-dimensional formation strength tests. Other embodiments provide multi-force tests that help in estimating the formation strength and composition.

The formation testing method described herein, and alternatives, may be performed in conjunction with obtaining subterranean core and/or connate fluid sampling. The formation stress can be estimated based on the force to fracture/deform the formation and contact area of the piston end 310, 312, 314. Additionally, providing pistons 300, 302, 304 with ends 310, 312, 314 having varying contact areas overcomes measurement uncertainty introduced by borehole wall surface discontinuities to thereby enhance measurement quality. Moreover, mechanically fracturing formation with a solid object, such as a piston, provides for a pure mechanical formation testing for formation strength and/or formation stress. Additionally, employing the device herein described samples in-situ formation mechanical properties while the formation is under a geostatic load.

In one embodiment, the tool includes an articulating piston that may engage the borehole wall using one or more angular positions with respect to the tool longitudinal axis. The several angular positions enable the piston force axis to be directed toward the formation at a selected angle. Strength testing using several angular positions provides information that may be used to estimate one or more of the several formation property components discussed above. The estimates may also include in-situ stress, Young's modulus, Poisson's ratio, unconfined compressive strength and/or confined compressive strength of the formation at the point of measurement. These parameters provide valuable clues regarding the viability of the formation for producing hydrocarbon reservoirs and/or structural soundness of the formation.

In one non-limiting operational example, multiple points along a borehole wall may be engaged using a rotating mandrel section to orient an extendable formation strength test tool to engage a formation traversed by the borehole at two or more points along a circumferential line about the borehole wall. In another embodiment, multiple points of engagement that are axially displaced along the borehole wall may be accomplished by moving the mandrel axially in the borehole. Articulating a piston, rotating the mandrel and/or translating the mandrel may be combined to conduct in-situ strength measurements with multiple degrees of freedom.

In some embodiments, two or more extendable formation strength test tool pistons may include wall-engaging surfaces having different contact surface areas. In one embodiment, a first extendable piston includes a wall-engaging surface having a radius of curvature in at least one direction that is selected to be about equal to the borehole radius. A second piston includes a wall-engaging surface that is smaller than the first piston wall engaging surface. Tests are conducted on the formation using each of the wall-engaging surfaces to determine formation strength parameters using force measurements indicative of force applied per unit area from the two ore more pistons.

In one example, a formation test tool includes at least three extendable pistons. A first extendable piston includes a wall-engaging surface having a radius of curvature in at least one direction that is selected to be about equal to the borehole radius. A second piston includes a wall-engaging surface that is smaller than the first piston wall engaging surface. And a third piston has a wall-engaging surface that is smaller than each of the surfaces of the first and second pistons. The third piston may include a surface area selected to concentrate applied force at the borehole wall. The third piston may include a surface topology that provides point and ridge loading surfaces.

Figure 8:
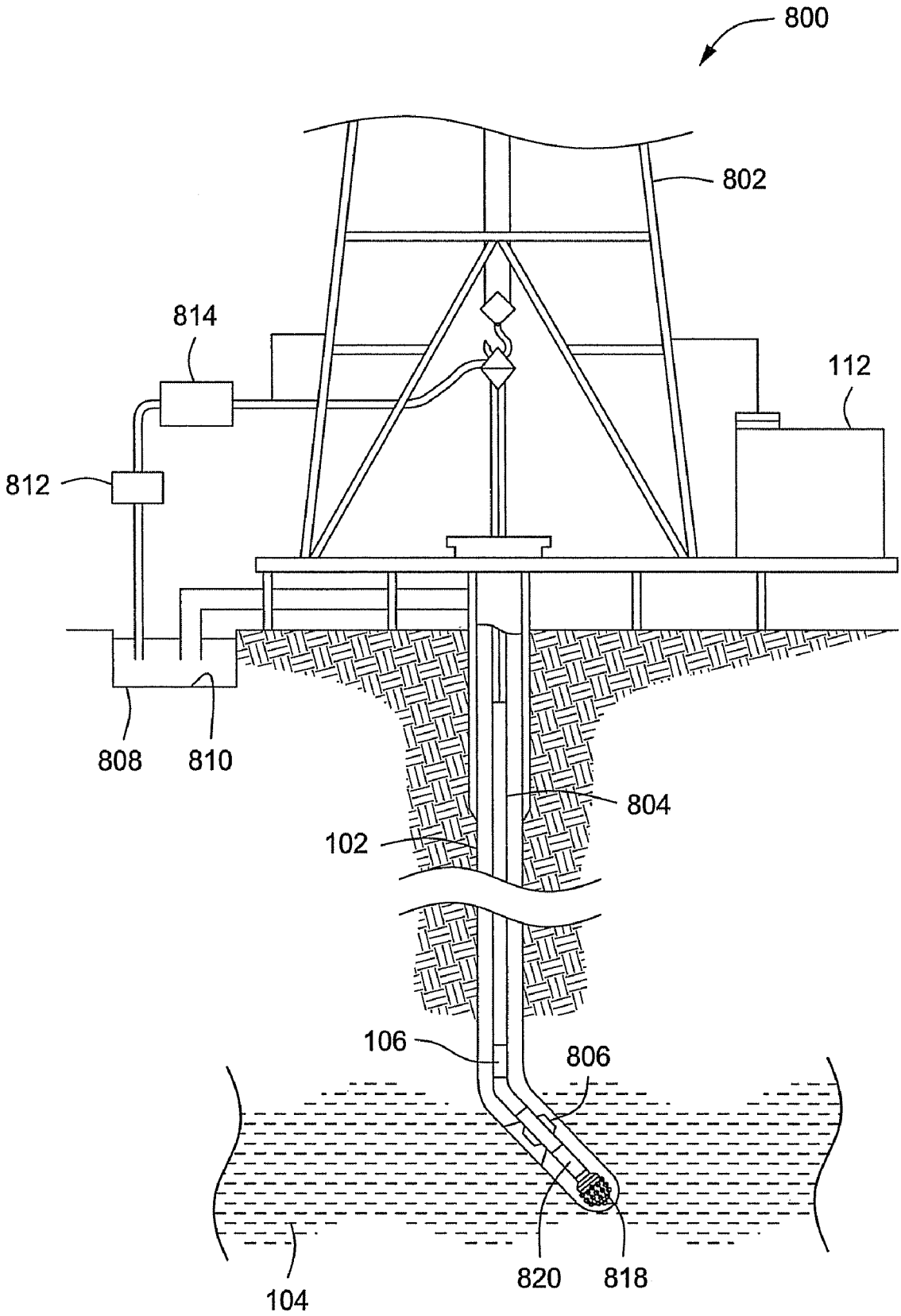
FIG. 8 is an elevation view of a non-limiting logging-while-drilling system that includes a formation strength test tool.

Those skilled in the art with the benefit of the above examples and description will appreciate that the tools described herein may be configured and used in a while-drilling environment. For example, FIG. 8 is an elevation view of a simultaneous drilling and logging system 800 that may incorporate non-limiting embodiments of the disclosure. A well borehole 102 is drilled into the earth under control of surface equipment including a drilling rig 802. In accordance with a conventional arrangement, rig 802 includes a drill string 804. The drill string 804 may be a coiled tube, jointed pipes or wired pipes as understood by those skilled in the art. In one example, a bottom hole assembly (BHA) 806 may include a tool string 106 according to the disclosure.

While-drilling tools will typically include a drilling fluid 808 circulated from a mud pit 810 through a mud pump 812, past a desurger 814, through a mud supply line 816. The drilling fluid 808 flows down through a longitudinal central bore in the drill string, and through jets (not shown) in the lower face of a drill bit 818. Return fluid containing drilling mud, cuttings and formation fluid flows back up through the annular space between the outer surface of the drill string and the inner surface of the borehole to be circulated to the surface where it is returned to the mud pit.

The system 800 in FIG. 8 may use any conventional telemetry methods and devices for communication between the surface and downhole components. In the embodiment shown mud pulse telemetry techniques may used to communicate information from downhole to the surface during drilling operations. A surface controller 112 similar in many respects to the surface equipment 112 of FIG. 1 may be used for processing commands and other information used in the drilling operations.

If applicable, the drill string 804 can have a downhole drill motor 820 for rotating the drill bit 818. In several embodiments, the while-drilling tool string 106 may incorporate a formation strength test tool 130 such as any of the several examples described herein and shown in FIGS. 1 through 7.

Having described above the several aspects of the disclosure, one skilled in the art will appreciate several particular embodiments useful in determining a property of an earth subsurface structure. In one particular embodiment a well tool for estimating one or more formation properties using in-situ measurements includes a carrier conveyable into a well borehole to a subterranean formation, an extendable member is coupled to the carrier, the extendable member having a distal end that engages a borehole wall location, the distal end having a curved surface having a radius of curvature in at least one dimension about equal to a borehole radius of the well borehole. A drive device extends the extendable member with a force sufficient to determine formation strength. At least one in-situ measurement device provides an output signal indicative of the formation strength.

In one particular embodiment, a well tool for estimating one or more formation properties using in-situ measurements includes a rotatable section that is rotatable with respect to the carrier about a longitudinal axis of the carrier, with an extendable member being coupled to the rotatable section. The extendable member having a distal end that engages a borehole wall location, the distal end includes a curved surface with a radius of curvature in at least one dimension about equal to a borehole radius of the well borehole.

In another particular embodiment, a well tool for estimating one or more formation properties using in-situ measurements includes an articulating coupling that couples ant extendable member to a carrier, and a positioning device to adjust an angle of extension of the extendable member with respect to a longitudinal axis of the carrier.

In yet another embodiment, a well tool for estimating one or more formation properties using in-situ measurements includes a two or more extendable members. A first extendable member is coupled to a carrier, the first extendable member having a distal end that engages a borehole wall location, the distal end having a curved surface having a radius of curvature in at least one dimension about equal to a borehole radius of the well borehole. A second extendable member has a distal end that engages a borehole wall location, the distal end having a surface smaller that the first extendable member surface.

In yet another embodiment, a well tool for estimating one or more formation properties using in-situ measurements includes a two or more extendable members. A first extendable member is coupled to a carrier, the first extendable member having a distal end that engages a borehole wall location, the distal end having a curved surface having a radius of curvature in at least one dimension about equal to a borehole radius of the well borehole. A second extendable member has a distal end that engages a borehole wall location, the distal end having a surface smaller that the first extendable member surface. A third extendable member having a distal end that engages a borehole wall location, the distal end having a curved surface having a radius of curvature smaller than a borehole radius of the well borehole and smaller than the first and second extendable member distal end surfaces.

The present disclosure is to be taken as illustrative rather than as limiting the scope or nature of the claims below. Numerous modifications and variations will become apparent to those skilled in the art after studying the disclosure, including use of equivalent functional and/or structural substitutes for elements described herein, use of equivalent functional couplings for couplings described herein, and/or use of equivalent functional actions for actions described herein. Such insubstantial variations are to be considered within the scope of the claims below.

What is claimed is:

1. An apparatus for estimating a formation strength comprising:

a carrier conveyable in a well borehole to a formation;

a member extendable from the carrier;

a distal end on the member adapted for mechanically engaging a borehole wall;

a drive device coupled to the member, so that formation properties are estimatible based on the distal end contact area and the force applied to the member required to deform the formation; and an articulating coupling that couples the member to the carrier and a positioning device to adjust an angular position of the member with respect to a longitudinal axis of the carrier.

2. An apparatus according to claim 1, wherein the carrier includes a wireline tool, a while drilling sub, or combinations thereof.

3. An apparatus according to claim 1 further comprising a rotatable section that is rotatable with respect to the carrier about a longitudinal axis of the carrier, the member being coupled to the rotatable section.

4. An apparatus according to claim 1 further comprising at least one in-situ measurement device providing an output signal indicative of formation strength.

5. An apparatus according to claim 1, the distal end having a surface with a radius of curvature in at least one direction about equal to or greater than a radius of the well borehole.

6. An apparatus for estimating a formation property comprising:

a carrier conveyable in a well borehole to a formation;

an extendable member that applies force to a borehole wall in a first direction, the extendable member having a selective angle of extension with respect to a carrier longitudinal axis; and at least one measurement device providing an output signal indicative of the angle of extension of the extendable member, the angle of extension being used in part for estimating the one or more formation properties.

7. An apparatus according to claim 6 further comprising an articulating coupling that adjusts an angle of extension of the extendable member.

8. An apparatus according to claim 6 further comprising a rotatable section that is rotatable with respect to the carrier about the longitudinal axis, the extendable member being coupled to the rotatable section.

9. An apparatus according to claim 6, wherein the extendable member comprises a plurality of extendable members.

10. A method for estimating one or more subterranean formation properties using in-situ measurements, the formation intersected by a borehole, the method comprising:

deforming the formation with a force applied from a substantially solid member along a contact surface area;

estimating a formation mechanical property based on the applied force and the contact surface area; and further comprising orienting the applied force in a first direction having a selective angle of extension with respect to the borehole axis and using a value representative of the angle of extension in part to estimate the one or more formation properties.

11. A method according to claim 10 wherein applying force includes applying force to a plurality of borehole wall locations.

12. A method for estimating a formation property, the method comprising:

applying force to a borehole wall portion using a first member having a distal end that engages a borehole wall, the distal end having a surface with a radius of curvature in at least one dimension about equal to or greater than a radius of the well borehole;

applying force to a borehole wall portion using a second extendable member having a distal end having a surface smaller than the surface of the first extendable member;

measuring in-situ parameters while force is being applied to the formation by the first extendable member and by the second extendable member; and estimating the formation property at least in part using the measured in-situ parameters.

13. A method according to claim 12 further comprising applying force to a borehole wall portion using a third extendable member having an end portion, the third extendable member end portion having a wall-engaging surface that includes a contact area that is smaller than each of the wall-engaging surfaces of the first extendable member and the second extendable member.

14. An apparatus for estimating a formation strength comprising:

a carrier conveyable in a well borehole to a formation;

a member extendable from the carrier;

a distal end on the member adapted for mechanically engaging a borehole wall;

a drive device coupled to the member, so that formation properties are estimatible based on the distal end contact area and the force applied to the member required to deform the formation; and wherein the member comprises a first member, the apparatus further comprising a second member, the second member having a distal end that engages the borehole wall, the distal end having a surface smaller than the first member surface.

15. The apparatus according to claim 14 further comprising a third member, the third member having a distal end that engages the borehole wall, the distal end having a surface smaller than the second extendable member surface.

* * * * *